United States Patent [19]

Howell

[11] Patent Number: 4,598,187

[45] Date of Patent: Jul. 1, 1986

[54] CURRENT LIMITING CIRCUIT BREAKER

[75] Inventor: Edward K. Howell, Simsbury, Conn.

[73] Assignee: General Electric Company, New York, N.Y.

[21] Appl. No.: 674,810

[22] Filed: Nov. 26, 1984

[51] Int. Cl.[4] ..... H01H 33/18

[52] U.S. Cl. ..... 200/147 R; 200/146 R; 200/144 AP; 335/16; 335/173; 361/42

[58] Field of Search ..... 200/147 R, 147 B, 146 R, 200/144 AP; 335/16, 173; 361/42

[56] References Cited

U.S. PATENT DOCUMENTS

| | | | |
|---|---|---|---|
| 3,987,382 | 10/1976 | Cataldo et al. | 335/16 |
| 4,001,742 | 1/1977 | Jencks et al. | 335/173 |
| 4,039,983 | 8/1977 | Terracol et al. | 335/16 |
| 4,115,829 | 9/1978 | Howell | 361/42 |
| 4,375,021 | 2/1983 | Pardini et al. | 200/147 B |
| 4,408,173 | 10/1983 | Adlerteg et al. | 335/16 |

FOREIGN PATENT DOCUMENTS

| | | | |
|---|---|---|---|
| 360109 | 3/1962 | Switzerland | 200/146 R |
| 365775 | 1/1963 | Switzerland | 200/146 R |
| 1103746 | 2/1968 | United Kingdom | 200/146 R |

*Primary Examiner*—Robert S. Macon

*Attorney, Agent, or Firm*—Richard A. Menelly; Walter C. Bernkopf; Fred Jacob

[57] ABSTRACT

A current limiting circuit breaker utilizes a first pair of contacts for carrying continuous current and controlled by an operating mechanism. A second pair of contacts is arranged on a pair of movable contact arms ahead of an arc chute for rapid repulsion under high current fault conditions.

11 Claims, 2 Drawing Figures

CURRENT LIMITING CIRCUIT BREAKER

BACKGROUND OF THE INVENTION

Current limiting circuit breakers, wherein the circuit breaker contact arms are arranged to separate independently from the circuit breaker operating mechanism, provide for rapid interruption of current within the first half cycle of the current waveform. U.S. Pat. No. 4,375,021 in the names of F. Pardini et al. describes a current limiting circuit breaker which employs a magnet motor to increase the rate at which the contacts become separated. In order to extinguish the arc that occurs between the contacts, a unique arc chute arrangement multi-functionally motors the arc as well as providing gases to enhance the arc extinction process. The movable contact arms described within the Pardini et al. patent both carry the current under quiescent steady state conditions as well as becoming separated under heavy overload conditions. To prevent undue heating of the contacts and the contact arms under such steady state conditions, the contacts are held together by substantial holding forces applied to the arms and the arms are fabricated from heavy copper bar stock to provide the required conductivity while maintaining a relatively low temperature. The heavy movable contact arms, in turn, require substantial magnetic forces to overcome the holding forces and to rapidly move the arms to the open position. For higher rated current limiting breakers, the movable contact arms, contacts and magnetic forces must be increased in size to handle the larger current ratings.

This invention proposes a current limiting circuit interrupter of reduced size by employing a separate pair of fast opening bridging contacts for handling the steady state or quiescent current on a continuous basis and a pair of movable contact arms of reduced size for magnetic repulsion upon overload.

U.S. Patent Application Ser. No. 610,947 in the name of E. K. Howell entitled "Solid State Circuit Interrupter" describes a solid state circuit interrupter wherein circuit interruption is obtained by a pair of contacts in parallel with a solid state switch such that the separating contacts do not produce an arc upon separation. No arc chute or other arc extinguishing means is required with the Howell solid state circuit interrupter. It has been discovered that a hybrid current limiting circuit interrupter combining the fast opening bridging contacts with the solid state switch provides a current limiting circuit interrupter of further reduced size by eliminating the arc chute.

U.S. Patent Application Ser. No. 665,841 also in the name of E. K. Howell entitled "Fault Current Interrupter" describes a circuit interrupter wherein circuit interruption is provided by means of a pair of contacts connected in parallel with a positive temperature coefficient resistor and a voltage dependent resistor. The current first transfers from the contacts immediately upon separation, through the positive temperature coefficient resistor and then through the voltage dependent resistor to interrupt the current. The bridging contacts of the instant invention can also be used with the positive temperature coefficient resistor and voltage dependent resistor for even faster circuit interruption. Both of the aforementioned U.S. Patent Applications are integrated herein for reference purposes.

SUMMARY OF THE INVENTION

The invention comprises a first pair of bridging contacts operated by the circuit breaker interruption mechanism for carrying steady state continuous and quiescent current. A lighter pair of movable contact arms supporting a pair of arcing contacts are connected in parallel and are arranged for enhanced magnetic repulsion upon the occurrence of substantial fault current. An arc chute in the vicinity of the arcing contacts extends and cools the arc to hasten its extinction.

DESCRIPTION OF THE PREFERRED EMBODIMENT

Figure 1:
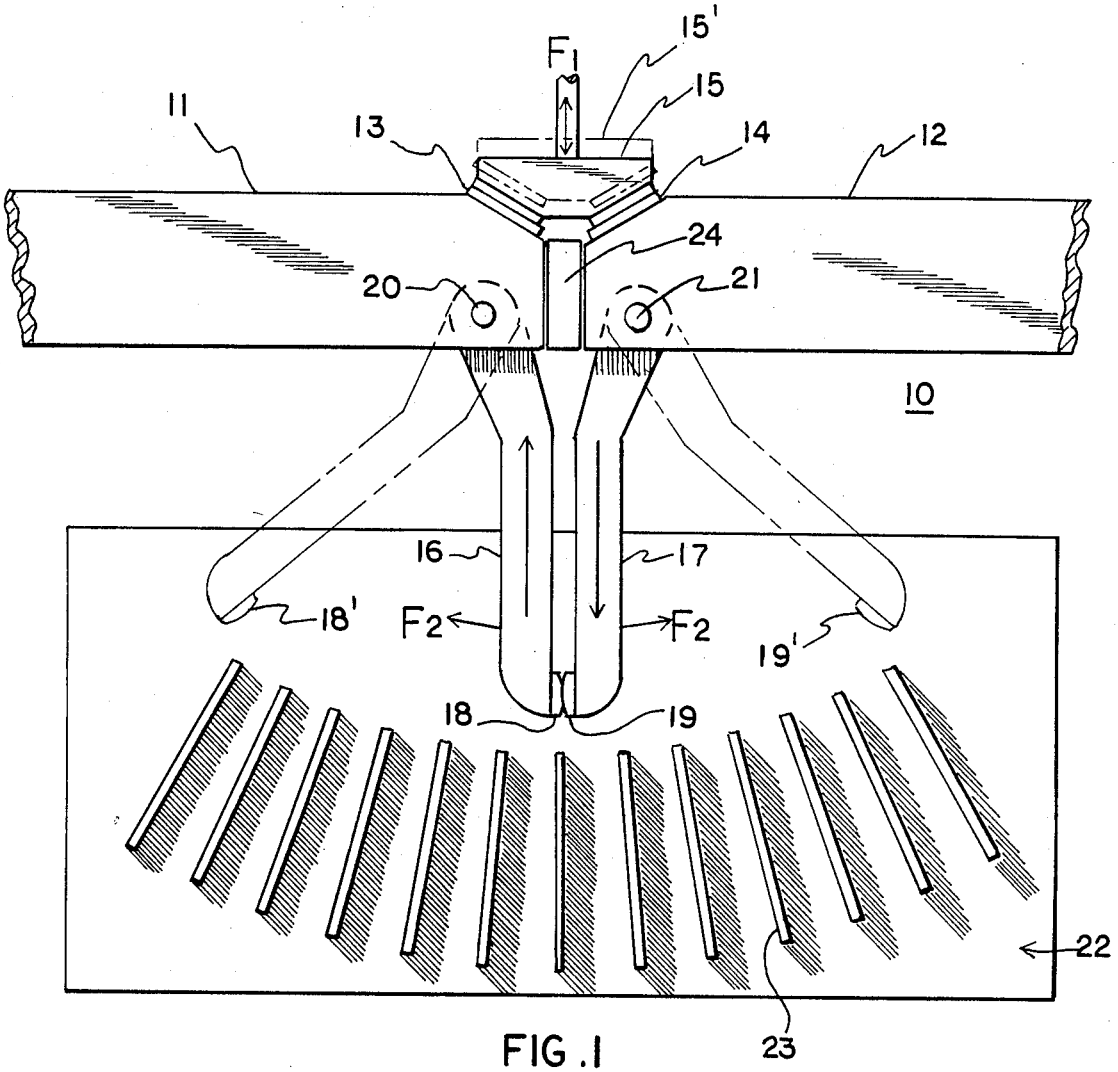
FIG. 1 is a plan view, of a current limiting circuit interrupter contact arrangement according to the invention utilizing a linear bridging contact assembly.

FIG. 1 contains a contact arrangement 10 wherein two stationary contact straps 11, 12 support a pair of stationary contacts 13, 14 and a bridging contact 15 each of which can be made of silver. The stationary contact straps are fixedly attached to a bottom portion of a molded case circuit breaker housing similar to that described within the Pardini et al. patent. Also supported on the stationary contact straps are a pair of movable contact arms 16, 17 containing a pair of arcing contacts 18, 19 which can be made of tungsten. The movable contact arms are pivotally connected to the stationary contact straps by means of pivot pins 20 and 21 which also provide electrical connection between the contact straps and the movable contact arms. The bridging contact 15 is arranged for linear translation relative to the stationary contacts 13, 14 and is separated from the stationary contacts 13 and 14 by means of an operating mechanism which, although not shown, is similar to that described within U.S. Pat. No. 4,001,742 in the names of C. L. Jencks et al. and reference should be made to this patent for a detailed description thereof. The sensor for determining overcurrent and operating the mechanism to provide a sufficient force, such as indicated at $F_1$, is provided by means of a current transformer and an electronic sensing circuit such as described, for example in U.S. Pat. No. 4,115,829 to E. K. Howell. Alternatively, an over-center toggle mechanism and operating spring within a molded case circuit breaker and controlled by a bi-metal and an electromagnet can also be employed. The movable contact arms 16, 17 become separated by the electromagnetic repulsive forces indicated at $F_2$ are generated by the interaction of magnetic fields with the current through the movable contact arms in the indicated directions. A plurality of metal plates can be employed to enhance the magnetic forces originating within the movable contact arms as described within the Pardini et al. patent. An arc chute 22 is arranged ahead of the arcing contacts 18, 19 and consists of a plurality of arc plates 23 to extinguish the arc that occurs when the arcing contacts become separated. This arrangement employs movable contact arms much lighter than that described within the aformentioned Pardini et al. patent since most of the quiescent current is carried by stationary contacts 13, 14 through the stationary contact straps 11, 12, and only a small amount of the current is carried through the arcing contacts 18, 19 via the movable contact arms 16, 17.

The arrangement of the two stationary contacts 13, 14 is such that when the bridging contact 15 is first separated a distance in the order of several thousandths of an inch from the stationary contacts, as indicated in phantom at 15', the 24 volts developed across the two arcs is sufficient to then rapidly drive the fault current through the movable contact arms and the arcing contacts. Current in the arms creates the electromagnetic forces $F_2$ operating to separate the movable contact arms and the movable contacts. The same electromagnetic forces drive the new arc that forms between the separated arcing contacts 18', 19' indicated in phantom, into the arc plates 23 which extend and cool the new arc until the current ceases. An insulative block 24 of plastic or ceramic material is provided between the stationary contact straps 11, 12 to prevent the arc which originates between the movable contacts 18, 19 from transferring to the stationary contacts. To assist in extinguishing the arc which forms between both the movable contacts, the insulative block can comprise a metal oxide varistor, MOV, such as described within the earlier referenced patent application, wherein the current transfers through the MOV when the voltage across the contacts exceeds the clamping voltage of the MOV.

Figure 2:
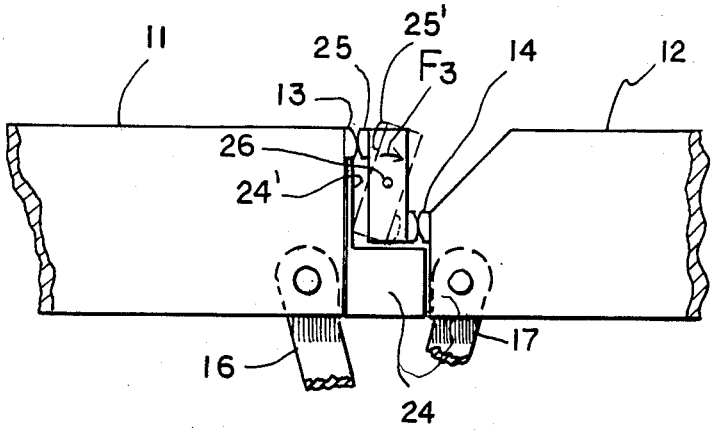
FIG. 2 is a plan view of a rotatable bridging contact assembly used in place of the linear bridging contact assembly within the current limiting circuit interrupter depicted in FIG. 1.

A rotatable bridging contact 25 is shown in FIG. 2 pivotally arranged between the stationary contact straps 11, 12 for rotation relative to the stationary contacts 13, 14 by means of a pivot 26 to increase the rate at which the bridging contact becomes separated from the stationary contacts. The lower rotational moment of intertia driven by the force indicated at $F_3$ increases the acceleration of the bridging contact over the linear bridging contact 15 shown in FIG. 1 by a factor of 2 to 3 for an equivalent bridging contact weight and force. The separation of the rotatable bridging contact 25 from the stationary contacts, indicated in phantom at 25' is also in the order of several thousandths of an inch and similarly results in the formation of two arcs having a combined voltage of 24 volts. To further insure that the arc does not re-strike between the stationary contacts 13, 14, a strip of insulating material 24' extending from the insulative block 24 is arranged close to stationary contact 13.

When either of these bridging contacts is used within the solid state circuit interrupter described within the former reference Howell Patent Application in place of the mechanical contacts in parallel with the solid state switch, the circuit interruption occurs in a shorter time than with the mechanical contacts originally disclosed. This is also true for the fault current interrupter described within the latter referenced Howell Patent Application, when the mechanical contacts in parallel with the PTC resistor and the MOV are replaced by the bridging contacts according to the instant invention.

Having described my invention, what I claim as new and desire to secure by Letters Patent is:

1. A current limiting circuit interrupter contact assembly comprising:

a pair of rigid conductor means having a pair of stationary contacts attached to one end of each of said rigid conductor means;

bridging contact means movably associated with said stationary contacts for making and interrupting a conductive path between said rigid conductor means across said stationary contacts by means of an opening force applied to said bridging contact upon occurrence of an overcurrent through said stationary contacts; and a pair of movable contact arms pivotally arranged at one end on said rigid conductor means, and a pair of movable contacts, each of said movable contact arms having one of said movable contacts at an opposite end for providing electrical connection between said movable contact arms, said movable contact arms being arranged side by side for electrodynamic repulsion to open said movable contacts independent of said opening force after said bridging contact has interrupted said conductive path through said stationary contacts.

2. The current limiting circuit interrupter contact assembly of claim 1 including an arc chute assembly proximate said movable contacts for receiving an arc formed between said movable contacts.

3. The current limiting circuit interrupter contact assembly of claim 1 wherein said stationary contacts comprise silver and said movable contacts comprise tungsten.

4. The current limiting circuit interrupter contact assembly of claim 1 wherein said movable contact arms comprise a pair of elongated arms arranged side by side whereby current flow through one of said arms produces a magnetic field interacting with current flow through the other of said arms sufficient to repel said arms to open said movable contacts after said bridging contact means becomes separated from said stationary contacts.

5. The current limiting circuit interrupter contact assembly of claim 2 wherein a pair of arcs are formed between said stationary contacts and said bridging contact means and wherein arc voltage across said pair of arcs motivates said current through said movable contact arms.

6. The current limiting circuit interrupter contact assembly of claim 1 wherein said pair of rigid conductor means is electrically connected in parallel with said pair of movable contact arms by means of a pair of conductive pivot pins through each of said movable contact arms and each of said rigid conductor means.

7. The current limiting circuit interrupter contact assembly of claim 1 further including a voltage dependent resistor having a predetermined clamping voltage electrically connected in parallel with said rigid conductor means for transferring current away from said movable contacts when voltage across said movable contacts exceeds said clamping voltage.

8. The current limiting circuit interrupter contact assembly of claim 1 wherein said bridging contact means is adapted for linear translation relative to said stationary contacts.

9. The current limiting circuit interrupter contact assembly of claim 1 wherein said bridging contact means is adapted for rotation relative to said stationary contacts.

10. The current limiting circuit interrupter contact assembly of claim 1 wherein said bridging contact means comprises a double-ended conductor having a contact formed on each end.

11. The current limiting circuit interrupter contact assembly of claim 1 including a voltage dependent resistor electrically connected in parallel with said rigid conductor means.

* * * * *